US011773864B2

(12) United States Patent
Son

(10) Patent No.: US 11,773,864 B2
(45) Date of Patent: Oct. 3, 2023

(54) IMPELLER

(71) Applicant: LG ELECTRONICS INC., Seoul (KR)

(72) Inventor: Minsu Son, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/532,183

(22) Filed: Nov. 22, 2021

(65) Prior Publication Data

US 2022/0163048 A1 May 26, 2022

(30) Foreign Application Priority Data

Nov. 25, 2020 (KR) ..... 10-2020-0160226

(51) Int. Cl.
*F04D 29/28* (2006.01)
*F04D 29/42* (2006.01)

(52) U.S. Cl.
CPC ..... *F04D 29/284* (2013.01); *F04D 29/4206* (2013.01)

(58) Field of Classification Search
CPC ..... F04D 29/284; F04D 29/4206
USPC ..... 415/203
See application file for complete search history.

(56) References Cited

U.S. PATENT DOCUMENTS 1,032,287 A * 7/1912 Kreher ..... F04D 29/2266 416/204 R
1,383,354 A * 7/1921 Wareing ..... F04D 29/2255 415/914
1,622,930 A * 3/1927 Theodor ..... F04D 29/287 415/914
2,161,182 A * 6/1939 Massey ..... F02B 33/00 48/189.5
2,753,808 A * 7/1956 Kluge ..... F01D 5/145 416/91
3,749,520 A * 7/1973 Bandukwalla ..... F04D 29/682 415/218.1
4,615,659 A * 10/1986 Sidransky ..... F04D 29/30 416/196 R
5,255,514 A * 10/1993 Wentworth, Jr. ..... F02B 51/06 60/605.1
6,007,300 A * 12/1999 Saeki ..... F04D 29/283 416/178
6,419,450 B1 * 7/2002 Lum ..... F04D 29/2222 416/186 A
6,860,715 B2 * 3/2005 Sekularac ..... F04D 29/681 415/115
7,261,513 B2 * 8/2007 Umeyama ..... F04D 29/30 415/58.4

(Continued)

OTHER PUBLICATIONS

Hongliang Wang, Effects of the Impeller Blade with a Slot Structure on the Centrifugal Pump Performance, Apr. 2, 2020, pp. 1-5 (Year: 2020).*

*Primary Examiner* — Hung Q Nguyen
*Assistant Examiner* — Anthony Donald Taylor, Jr.
(74) *Attorney, Agent, or Firm* — KED & ASSOCIATES

(57) ABSTRACT

An impeller includes a shroud including an inlet, a hub facing the shroud, and a plurality of blades disposed between the hub and the shroud and arranged circumferential direction along a circumference of the inlet. Each of the plurality of blades has a slot which is positioned adjacent to the inlet.

9 Claims, 8 Drawing Sheets

(56) References Cited

U.S. PATENT DOCUMENTS

| | | | | |
|---|---|---|---|---|
| 7,857,577 | B2 * | 12/2010 | Eslinger | F04D 29/688 416/235 |
| 8,215,918 | B2 * | 7/2012 | Hwang | F04D 29/681 416/231 B |
| 9,551,225 | B2 * | 1/2017 | Japikse | F04D 29/444 |
| 10,119,402 | B2 * | 11/2018 | Scheri | F02B 39/00 |
| 2010/0221105 | A1 * | 9/2010 | Markovitch | F04D 29/2261 415/203 |
| 2013/0195608 | A1 * | 8/2013 | Gharaibah | F04D 29/284 415/115 |
| 2014/0178190 | A1 * | 6/2014 | Gahlot | E21B 43/128 415/199.1 |
| 2016/0146214 | A1 * | 5/2016 | Marsis | F04D 31/00 415/203 |

* cited by examiner

IMPELLER

CROSS-REFERENCE TO RELATED PATENT APPLICATIONS

This application claims priority to Korean Patent Application No. 10-2020-0160226, filed Nov. 25, 2020, whose entire disclosures are hereby incorporated by reference.

BACKGROUND OF THE DISCLOSURE

Field of the Disclosure

The present disclosure relates to an impeller, and more particularly, to an impeller capable of minimizing vortex flow generated between blades to reduce a load of the impeller and improve the performance thereof.

Related Art

A compressor or pump for compressing a fluid or the like may be provided with an impeller that rotates to pressurize the fluid.

Hereinafter, referring to FIG. 1, an impeller 20 may be rotatably installed inside a centrifugal pump (or compressor) 10. The impeller 20 may include a hub 21 coupled to a rotation shaft, a plurality of blades 23 for pressing the fluid, and a shroud (not shown) for providing a flow path of a fluid. The plurality of blades 23 may be arranged in a circumferential direction around the rotation axis of the hub 21.

The fluid may flow in an axial direction of the impeller 20 to be introduced into a rotational center portion of the impeller 20 through an inlet 221. The impeller 20 may compress the introduced fluid using centrifugal force. The impeller 20 may compress the fluid through a process of accelerating the fluid introduced into the rotational center portion and discharging it radially through the flow path 24 between the blades 23. The fluid discharged radially may be discharged to the outside through a discharge port 12 of the centrifugal pump 10.

Further, referring to FIG. 2, each of the blades 23 may include a positive pressure surface 231 that rotates to pressurize the fluid, and a negative pressure surface 232 formed opposite to the positive pressure surface 231. In addition, the blades 23 are disposed adjacent to the center of the hub 21, and each of the blades 23 may be provided with a leading edge 233 constituting one end thereof and a trailing edge 234 constituting the other end thereof adjacent to an outer peripheral end of the hub 21.

The flow path 24 may be formed between the adjacent ones of the plurality of blades 23. Specifically, the flow path 24 may be formed between the positive pressure surface 231 of one blade 23 and the negative pressure surface 232 of another blade 23 adjacent to the one blade 23.

The fluid introduced into the rotational center portion of the impeller 20 through the inlet 221 may pass through the flow path 24 between the positive pressure surface 231 and the negative pressure surface 232 to be discharged radially.

On the other hand, when the impeller 20 rotates, the positive pressure surface 231 may compress the fluid so that the pressure of the fluid increases in the vicinity of the positive pressure surface 231 and decreases in the vicinity of the negative pressure surface 232. Accordingly, while the fluid passes through the flow path 24, the fluid flows from the positive pressure surface 231 to the negative pressure surface 232 to generate vortex flow.

The vortex flow causes energy loss of the fluid, which lowers a flow rate and a lift of the impeller 20 compared to when the impeller 20 rotates at the same rotation speed without generating any vortex flow.

In addition, if the energy loss of the fluid flowing inside the impeller 20 is increased, the pressure inside the impeller 20 is decreased, so that cavitation may easily occur. If the cavitation occurs for a long time, the performance degradation and structural damage to the impeller 20 and the centrifugal pump 10 may occur.

SUMMARY

The present disclosure is provided to resolve the above problems.

The present disclosure provides an impeller capable of reducing load of the impeller and improving the performance without significant structural change of blades.

Further, the present disclosure provides an impeller capable of reducing pressure difference between a positive pressure surface and a negative pressure surface and reducing a vortex flow generated between the blades.

In addition, the present disclosure provides an impeller capable of reducing cavitation and preventing structural damage to the impeller.

It will be clearly understood by those skilled in the art from the following description that the present disclosure may also provide an impeller capable of resolving problems other than the problems mentioned above.

In an aspect, an impeller according to one embodiment of the present disclosure may include a shroud including an inlet, a hub facing the shroud, and a plurality of blades disposed between the hub and the shroud and arranged circumferential direction along a circumference of the inlet, wherein a slot may be formed in each of the plurality of blades and may be located adjacent to the inlet.

The details of other embodiments are included in the detailed description and drawings.

DESCRIPTION OF EXEMPLARY EMBODIMENTS

Figure 1:
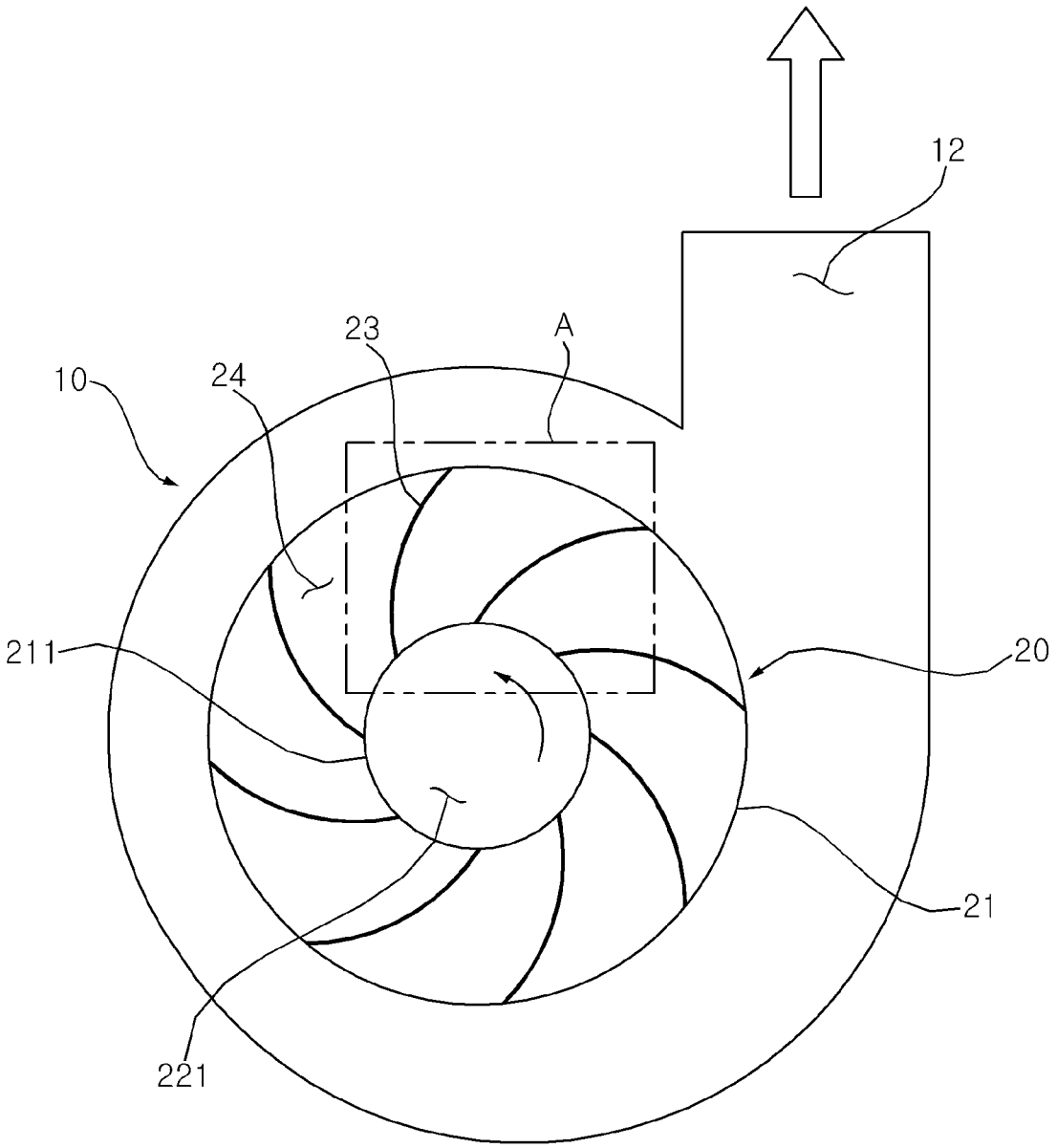
FIG. 1 is a cross-sectional view showing a conventional impeller.

Advantages and features of the present disclosure and methods of achieving them will become apparent with reference to embodiments described below in detail in conjunction with the accompanying drawings. However, the present disclosure is not limited to the embodiments disclosed below, but can be implemented in various different forms. The embodiments only fully disclose the present disclosure and are provided to allow those who have common knowledge in the art to which the present disclosure pertains to fully understand the scope of the present disclosure. The present disclosure is only defined by the scope of the claims. Like reference numerals refer to like elements throughout the specification.

Spatially relative terms such as "below", "beneath", "lower", "above", "upper", and the like may be used to easily describe the correlation between elements and other elements. These spatially relative terms should be understood as terms encompassing different orientations of the elements in use or operation in addition to the orientations of the elements shown in the drawings. For example, when the elements shown in the drawings are turned over, one element described as "beneath" or "below" another element may be placed "above" the other element. Accordingly, the exemplary term "below" may encompass both orientations below and above. The elements may also be oriented in other orientations, and thus the spatially relative terms may be interpreted according to orientations.

The terminology used herein is for the purpose of describing the embodiments and is not intended to limit the present disclosure. In this specification, the singular forms also include the plural forms, unless the context specifically indicates otherwise in this specification. The terms "comprises" and/or "comprising" are used in this specification to indicate that a stated element, step and/or operation do not exclude the presence or addition of one or more other elements, steps and/or operations.

Unless otherwise defined, all terms (including technical and scientific terms) used herein may be used with the meaning commonly understood by those of ordinary skill in the art to which the present disclosure belongs. In addition, terms defined in a commonly used dictionary are not to be interpreted ideally or excessively unless clearly defined in particular.

In the drawings, the thickness or size of each element is exaggerated, omitted, or schematically illustrated for convenience and clarity of description. Further, the size and area of each element do not fully reflect the actual size or area.

Figure 3:
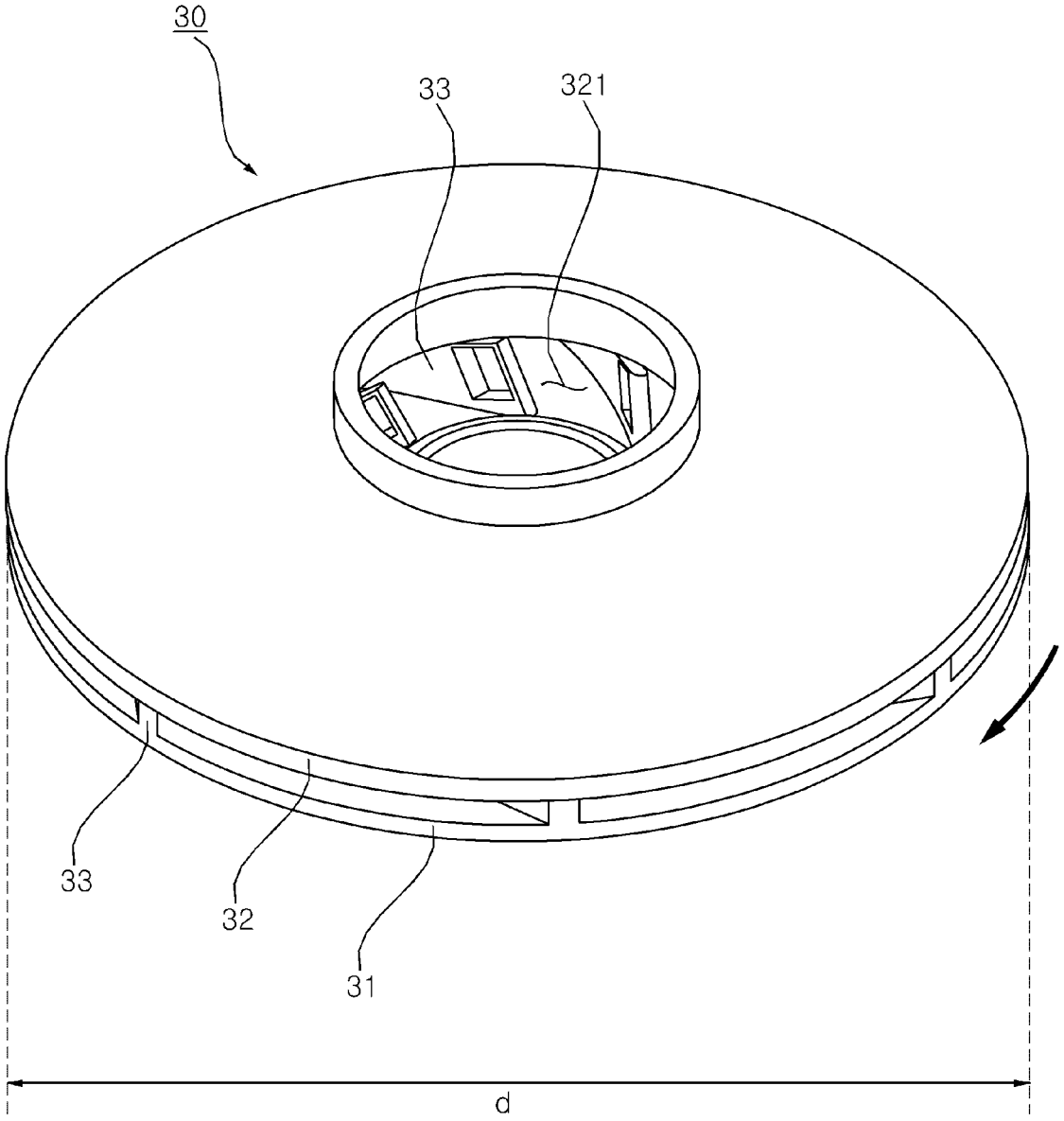
FIG. 3 is a perspective view of an impeller according to one embodiment of the present disclosure.
Figure 4:
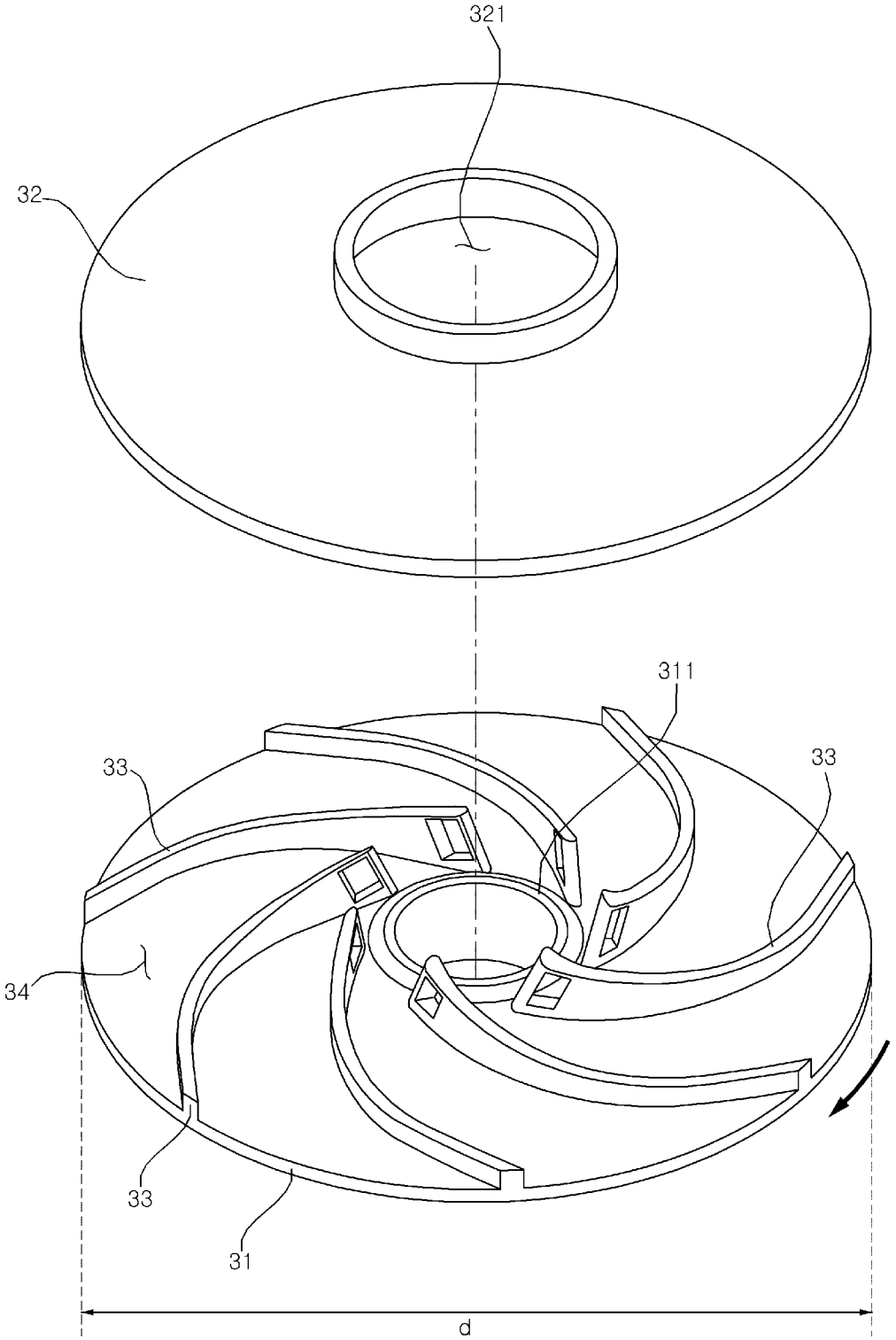
FIG. 4 is an exploded perspective view of the impeller shown in FIG. 3.

Hereinafter, referring to FIGS. 3 and 4, an impeller 30 according to one embodiment of the present disclosure may include a hub 31, a shroud 32, and a plurality of blades 33.

The hub 31, the shroud 32, and the plurality of blades 33 are each manufactured, and the plurality of blades 33 may be coupled to the shroud 32 and the hub 31. The hub 31 and the shroud 32 may be disposed to face each other. The plurality of blades 33 may be disposed between the hub 31 and the shroud 32. The hub 31 and the shroud 32 may be arranged in parallel with each other.

A lower end 336 of the blade 33 (see FIG. 6) may be coupled to an upper surface of the hub 31. An upper end 335 of the blade 33 (see FIG. 6) may be coupled to a lower surface of the shroud 32.

The hub 31, the shroud 32, and the plurality of blades 33 of the impeller 30 may be made of a metal material having plasticity. For example, the hub 31, the shroud 32, and the plurality of blades 33 may be made of an aluminum alloy.

The hub 31 and the shroud 32 may have a circular shape so as to be suitable for rotation about a rotation shaft (not shown) to which a motor is connected. An outer diameter d of the hub 31 may be the same as that of the shroud 32 or approximately similar to that of the shroud 32. The outer diameter d may mean an outer diameter d of the impeller 30.

A shaft connection part 311 may be formed at a rotational center portion of the hub 31. A shaft of the motor (not shown) may be connected to the shaft connection part 311. The motor (not shown) may rotate the impeller 30 including the hub 31. An inlet 321 may be formed at a rotational center portion of the shroud 32. The shaft connection part 311 and the inlet 321 may be disposed coaxially.

The plurality of blades 33 may be coupled to the upper surface of the hub 31. The plurality of blades 33 may be arranged circumferentially about the rotation center of the impeller 30. The plurality of blades 33 may be arranged circumferentially along the circumference of the inlet 321.

The blade 33 may have a three-dimensional curved shape. The blade 33 may have a spiral shape extending in a curvature along the rotation direction of the impeller 30. The blade 33 may be formed by spirally bending a panel having a rectangular shape or an air-foil shape.

Figure 5:
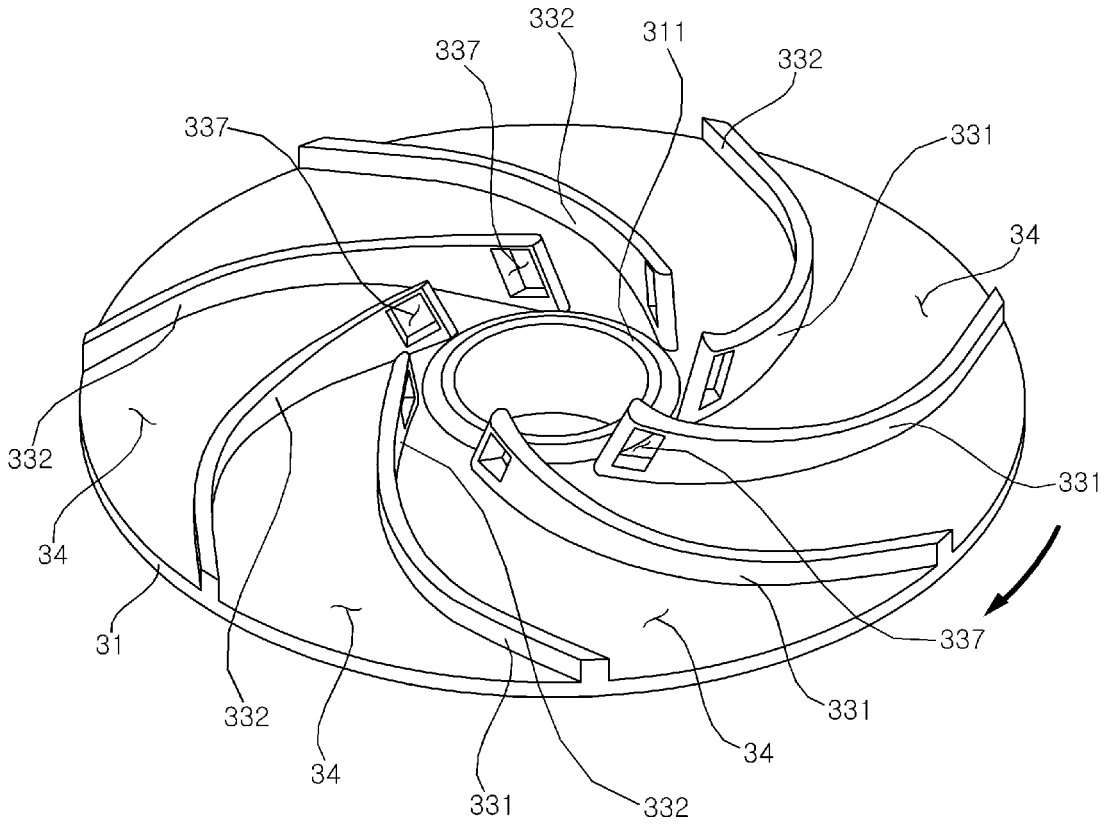
FIG. 5 is a view illustrating a hub and a blade of FIG. 3.
Figure 6:
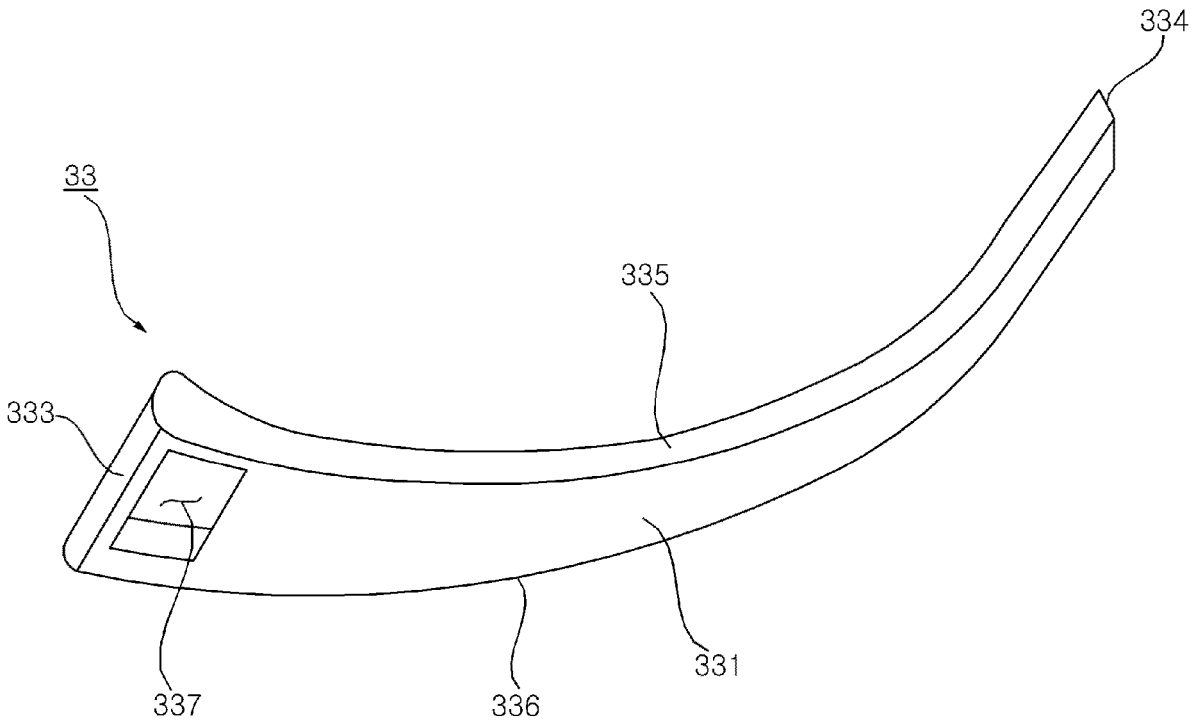
FIG. 6 is a view showing a blade of the impeller according to one embodiment of the present disclosure.
Figure 7:
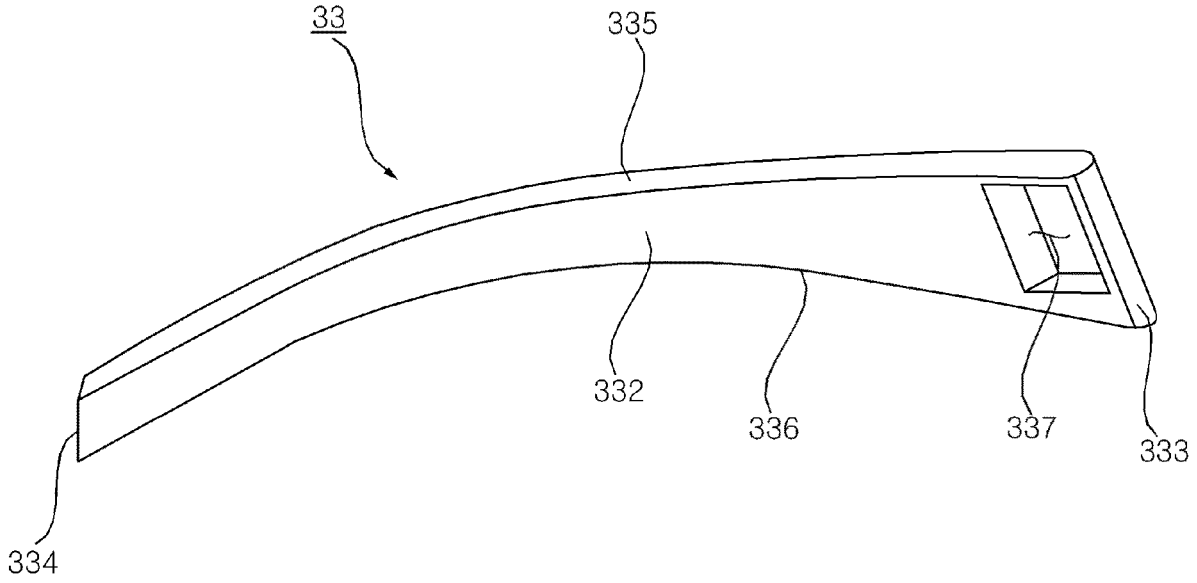
FIG. 7 is a view of the blade shown in FIG. 6 viewed from another direction.

Hereinafter, referring to FIGS. 5 to 7, the blade 33 may include a positive pressure surface 331, a negative pressure surface 332, a leading edge 333, a trailing edge 334, an upper end 335, and a lower end 336.

The positive pressure surface 331 may constitute one surface of the blade 33 for compressing a fluid. The negative pressure surface 332 may be formed on the opposite side of the positive pressure surface 331 to constitute the other surface of the blade 33.

The leading edge 333 may be formed at an inner end of the blade 33. The leading edge 333 may be positioned adjacent to the rotation center of the impeller 30. The leading edge 333 may be arranged circumferentially along the circumference of the shaft connection part 311 and/or the inlet 321. The leading edge 333 may have a rounded shape.

The trailing edge 334 is formed on the opposite side of the leading edge 333, and may be formed at an outer end of the blade 33. The trailing edge 334 may be disposed adjacent to an outer peripheral end of the impeller 30.

The plurality of blades 33 may be combined with the hub 31 and the shroud 32 to form a flow path 34. The flow path 34 may be formed between the adjacent ones of the plurality of blades 33. Each of the flow paths 34 may be formed between the positive pressure surface 331 provided on one of the plurality of blades 33 and the negative pressure surface 332 provided on another one of the plurality of blades 33. Each of the flow paths 34 may be partitioned by being surrounded by the upper surface of the hub 31, the lower surface of the shroud 32, and the adjacent two blades 33.

When the impeller 30 rotates, a fluid may flow in an axial direction to be introduced into the inlet 321. The introduced fluid may be discharged radially outward of the impeller 30 through the flow paths 34. When the impeller 30 rotates, the positive pressure surface 331 of the blade 33 may compress the fluid.

A slot 337 may be formed in each of the plurality of blades 33. The slot 337 may be located adjacent to the inlet 321. The slot 337 may be located adjacent to the shaft connection part 311.

Accordingly, the pressure difference between the positive pressure surface 331 and the negative pressure surface 332 can be reduced.

Therefore, it is possible to reduce a vortex phenomenon that occurs when the fluid flows from the positive pressure surface 331 to the negative pressure surface 332.

As a result, cavitation can be reduced, and structural damage to the impeller 30 can be prevented.

Figure 8:
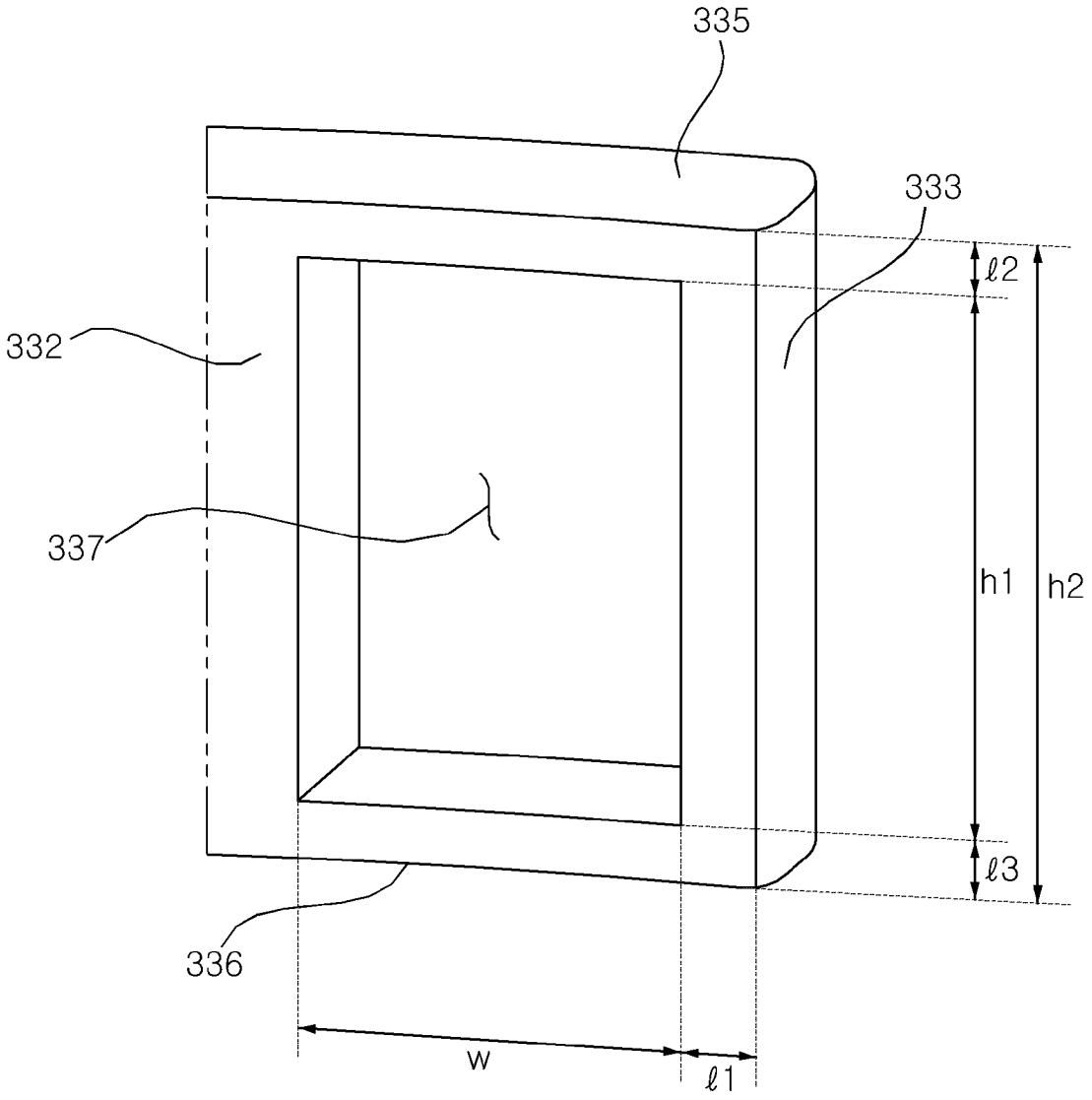
FIG. 8 is an enlarged view of a portion of the blade of the impeller according to one embodiment of the present disclosure.

Hereinafter, referring to FIGS. 7 and 8, the slot 337 may be disposed closer to the leading edge 333 of the blade 33 than the trailing edge 334 of the blade 33.

Figure 2:
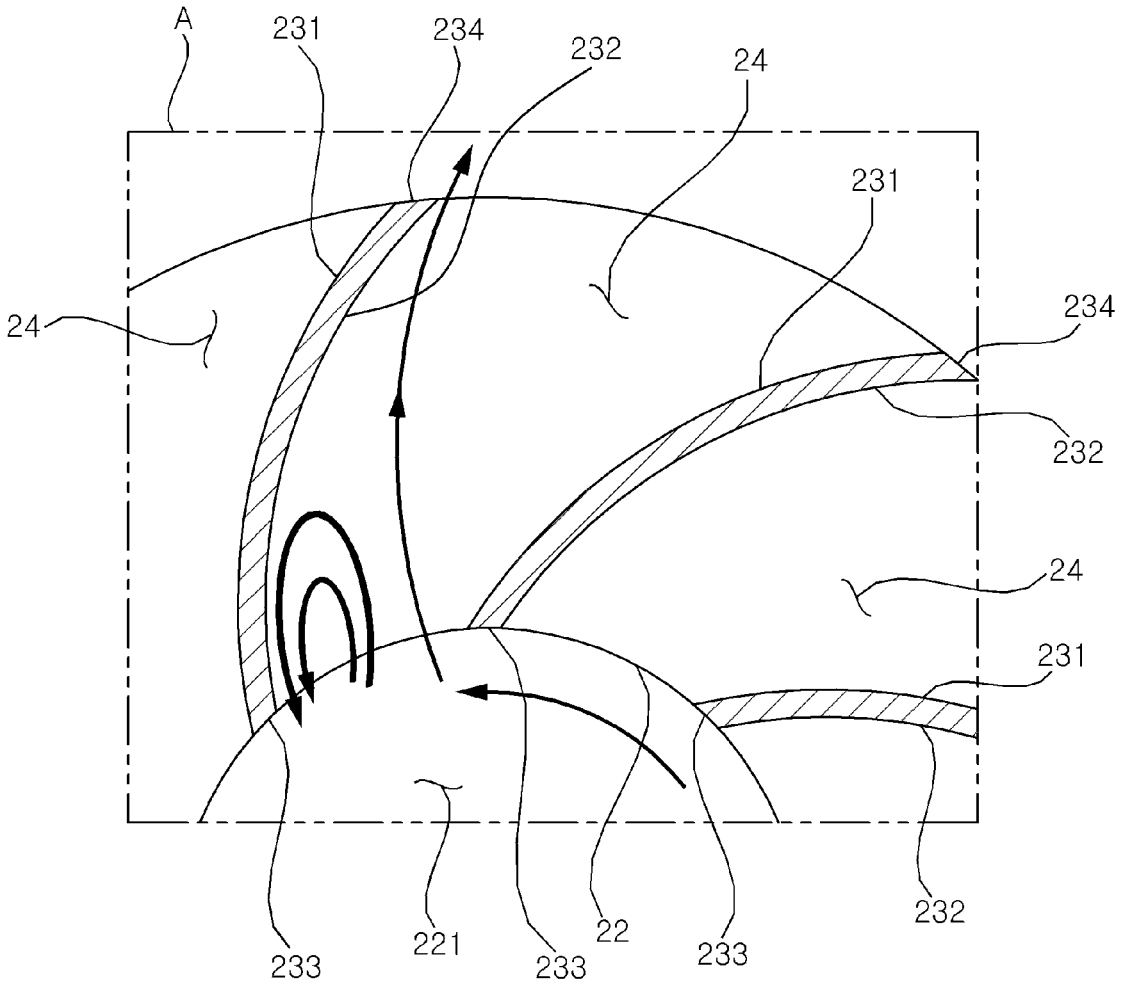
FIG. 2 is an enlarged view of a portion of the impeller of FIG. 1 in which a flow of fluid is indicated.

In the prior art, vortex flows may occur in particular near the leading edge 333 (see FIG. 2).

Accordingly, the slot 337 is preferably disposed closer to the leading edge 333 of the blade 33 than to the trailing edge 334 of the blade 33. It is better that the slot 337 is positioned closer to the leading edge 333 as much as possible. A distance l1 between the slot 337 and the leading edge 333 of the blade 33 may be smaller than a width w of the slot 337. A height h1 of the slot 337 may be larger than the width w of the slot 337.

Accordingly, it is possible to significantly reduce vortex flow generated near the leading edge 333 in particular (see FIG. 2).

On the other hand, the width w of the slot 337 may be determined in a range of 2% to 5% of the outer diameter d of the impeller 30. The width w of the slot 337 may be set in a range of 2% to 5% of the outer diameter d of the hub 31 and/or the shroud 32.

When the width w of the slot 337 is less than 2% of the outer diameter d of the impeller 30, the effect of reducing the pressure difference between the positive pressure surface 331 and the negative pressure surface 332 may be insignificant.

When the width w of the slot 337 exceeds 5% of the outer diameter d of the impeller 30, a flow rate loss larger than the effect of reducing the load of the impeller 30 due to a decrease in the pressure difference may occur. That is, if the width w of the slot 337 is too large, the performance of the impeller 30 may deteriorate due to a flow rate loss.

Therefore, the width w of the slot 337 is preferably set in the range of 2% to 5% of the outer diameter d of the impeller 30.

Meanwhile, the hub 31 and the shroud 32 may be disposed parallel to each other. That is, the flow path 34 through which a fluid passes may have a constant height. The height of the flow path 34 may be equal to or smaller than a height h2 of the blade 33.

The slot 337 may be formed to extend in an up-down direction and may be located adjacent to the upper end 335 of the blade 33 and the lower end 336 of the blade 33. A distance l2 between the upper end 335 and the slot 337 may be smaller than the height h1 of the slot 337. A distance l3 between the lower end 336 and the slot 337 may be smaller than the height h1 of the slot 337.

A distance l2 between the slot 337 and the upper end 335 may be approximately equal to the distance l1 between the slot 337 and the leading edge 333 of the blade 33. The distance l3 between the slot 337 and the lower end 336 may be approximately equal to the distance l1 between the slot 337 and the leading edge 333 of the blade 33.

If the slot 337 is not located adjacent to the upper end 335 and the lower end 336, the effect of reducing the pressure difference between the positive pressure surface 331 and the negative pressure surface 332 may be insignificant between the slot 337 and the upper end 335 and between the slot 337 and the lower end 336.

Accordingly, the slot 337 is preferably formed adjacent to the upper end 335 of the blade 33 and the lower end 336 of the blade 33.

The slot 337 may have a rectangular shape. The slot 337 may be formed parallel to the upper end 335 of the blade 33. The slot 337 may be formed parallel to the lower end 336 of the blade 33.

Accordingly, it is possible to maximize the effect of reducing the pressure difference by reducing an area between the slot 337 and the upper end 335 and an area between the slot and the lower end 336.

The impeller according to the present disclosure exhibits one or more of the following effects.

First, it is possible to reduce the load on the impeller and improve the performance without significant structural change of the blades.

Second, the pressure difference between the positive pressure surface and the negative pressure surface can be reduced, and the vortex flow generated between the blades can be reduced.

Third, by reducing the pressure change inside the impeller, cavitation can be reduced, and structural damage to the impeller can be prevented.

The effects of the present disclosure are not limited to the effects mentioned above, and other effects not mentioned will be clearly understood by those skilled in the art from the description of the claims.

In the above, preferred embodiments of the present disclosure have been illustrated and described, but the present disclosure is not limited to the specific embodiments described above. Various modifications may be made by those of ordinary skill in the art to which the present disclosure pertains without departing from the gist of the present disclosure as claimed in the claims, and these modifications should not be individually understood from the technical spirit or perspective of the present disclosure.

REFERENCE NUMERALS

30: impeller
31: hub
32: shroud
33: blade
333: leading edge
334: trailing edge
337: slot

What is claimed is:

1. An impeller, comprising:
a shroud including an inlet at a center thereof;
a hub facing the shroud; and
a plurality of blades disposed between the hub and the shroud and arranged in a circumferential direction along a circumference of the inlet, wherein each of the plurality of blades is elongated along a radial outward direction from a periphery of the inlet to define an inner end adjacent to the inlet and an outer end opposite to the inner end, wherein each of the plurality of blades has a slot adjacent to the inner end thereof rather than the outer end thereof, and wherein a distance between the slot and the inner end is smaller than a width of the slot, and a distance between the slot and an upper end of the blade and a distance between the slot and a lower end of the blade are smaller than a height of the slot.

2. The impeller of claim 1, wherein the slot is positioned closer to a leading edge of the blade than to a trailing edge of the blade.

3. The impeller of claim 1, wherein the width of the slot is set in a range of 2% to 5% of an outer diameter of the shroud and/or the hub.

4. The impeller of claim 1, wherein the slot extends in an up-down direction and is formed adjacent to the upper end of the blade and the lower end of the blade.

5. The impeller of claim 4, wherein the slot has a rectangular shape.

6. The impeller of claim 5, wherein the slot is formed parallel to the upper end of the blade and the lower end of the blade.

7. The impeller of claim 1, wherein the height of the slot is larger than the width of the slot.

8. A compressor comprising the impeller of claim 1.

9. A centrifugal pump comprising the impeller of claim 1.

* * * * *